United States Patent [19]

Month et al.

[11] 4,258,284

[45] Mar. 24, 1981

[54] ELECTRON TUBE HAVING ELECTRODE CENTERING MEANS

[75] Inventors: Alfred Month; Donald B. Kaiser, both of Lancaster, Pa.

[73] Assignee: RCA Corporation, New York, N.Y.

[21] Appl. No.: 16,109

[22] Filed: Feb. 28, 1979

[51] Int. Cl.[3] ..... H01J 29/02; H01J 29/82; H01J 31/38

[52] U.S. Cl. ..... 313/390; 313/456

[58] Field of Search ..... 313/390, 383, 451, 456, 313/417

[56] References Cited

U.S. PATENT DOCUMENTS

| | | | |
|---|---|---|---|
| 2,897,389 | 7/1959 | Salgo | 313/390 |
| 2,951,962 | 9/1960 | Miller et al. | 313/383 |
| 2,991,390 | 7/1961 | Shrader | 313/451 |
| 3,038,094 | 6/1962 | Ney | 313/383 |
| 3,183,388 | 5/1965 | Townsend et al. | 313/451 |
| 3,325,672 | 6/1967 | Funahashi et al. | 313/390 X |
| 3,529,196 | 9/1970 | Bell | 313/456 |

FOREIGN PATENT DOCUMENTS

| | | | |
|---|---|---|---|
| 725693 | 3/1955 | United Kingdom | 313/456 |

*Primary Examiner*—Robert Segal

*Attorney, Agent, or Firm*—Eugene M. Whitacre; Dennis H. Irlbeck; Vincent J. Coughlin, Jr.

[57] ABSTRACT

An electron tube, preferably a camera tube, has an improved structure for supporting and centering a cylindrical electrode within a tubular envelope having a precisely formed inner surface. The support structure comprises a centering ring that has a plurality of radial sectors formed to a ring circumference and a plurality of resilient radial finger-like members formed intermittent the radial sectors. The ring circumference is formed within a close spacing of the inner surface of the envelope and is attached to the electrode so that the ring circumference is substantially concentric with the outer surface of the electrode. The finger-like members of the ring are formed to define an outer diameter that is greater than the inner diameter of the envelope, so that when the electrode with the attached ring is inserted into the envelope, the members flexibly bear against the inner envelope surface and guide the ring into position without deforming the radial sectors. The concentricity of the electrode to the envelope is established by the spacing between the radial sectors and the inner surface of the envelope.

10 Claims, 5 Drawing Figures

ELECTRON TUBE HAVING ELECTRODE CENTERING MEANS

BACKGROUND OF THE INVENTION

1. Field of the Invention

This invention relates to an improved electrode supporting structure in an electron tube, and pertains more particularly to an improved means for centering and mounting the electrode within an envelope of a television camera tube.

2. Description of the Prior Art

In the prior art, certain photoconductive type pickup tubes, commonly known as camera tubes, are often used in television broadcast cameras. Conventional tubes of this type generally comprise a tubular glass envelope within which is contained several electrode elements, including an elongated hollow tubular beam focusing electrode, typically known as the "G3" electrode.

The operating characteristics of the camera tube may be adversely affected if its electrodes become even slightly misaligned. For example, in the usual color broadcast camera, there are three camera tubes aligned by their outer envelopes in a yoke within which a magnetic field is applied. Each of these three camera tubes transmits an image, for example, in red, blue or green, to a display screen in substantial register to obtain a color picture. If the focusing electrode of each tube is not properly centered within the magnetic field, the response of each tube will not be homogeneous and the register will be poor. Accordingly, for good register it is desirable that the optics of each camera tube be substantially the same which requires, in part, that the focusing electrodes be concentrically supported with respect to the tube envelope.

There are many known arrangements for supporting and positioning electrodes within the tubular envelope of a camera tube. A typical supporting structure includes a plurality of spaced spring clips such as those shown in U.S. Pat. No. 3,038,094, issued June 5, 1962 or finger-like members as shown in U.S. Pat. No. 2,951,962, issued on Sept. 6, 1960. These may be disposed on one end or both ends of an elongated cylindrical electrode. The spring elements are of flexible material and are pressed against the inner surface of the wall of the tubular envelope to support and position the electrode. Other known electrode supports include a conical shaped bulb-spacer as described in U.S. Pat. No. 2,897,389, issued on July 28, 1959 and a ring with a flared portion as shown in U.S. Pat. No. 3,183,388, issued on May 11, 1965. The conical spacer and flange portion in these two arrangements, respectively, are formed of resilient material and yieldably engage the inner walls of the tube envelope when they are slid into the bulb envelope.

The problem with these arrangements, and other known electrode supports, is that the structural members that are supporting the electrodes are also relied upon to provide the desirable and critical concentricity of the electrodes within the tube envelope. Many factors, such as vibration, shock and thermal stresses, may cause these resilient and flexible supports to shift position relative to the envelope or the electrode. For example, even an electrode that is fixtured during fabrication to be substantially concentric with the envelope may lose its concentricity upon subsequent thermal processing. Such supporting structures, structurally susceptible to concentricity deviations under normally expected operating conditions, are not desirable.

SUMMARY OF THE INVENTION

An electron tube, including an evacuated hollow envelope with a precisely formed inner surface and a cylindrical electrode contained within the envelope, has an improved structure for supporting the electrode in the envelope. The support structure comprises a centering ring having a plurality of radial sectors that are formed with a circumference close to that of the inner surface of the envelope. The ring is attached to the electrode so that the ring circumference is substantially concentric with the outer surface of the electrode. The supporting structure further comprises means formed to flexibly contact the inner surface of the envelope and to fit the electrode with the centering ring to the envelope so that the concentricity of the electrode to the envelope is determined by the spacing between the ring circumference and the inner surface of the envelope.

Detailed Description of the Preferred Embodiment

Figure 1:
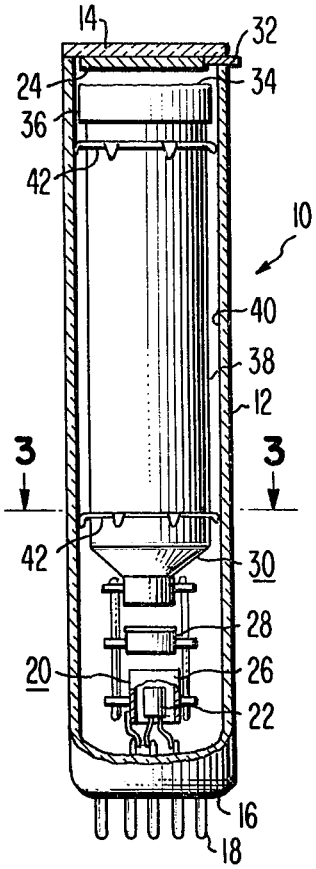
FIG. 1 is an elevational view, partly in section, of a photoconductive camera tube embodying the improved electrode supporting structure.

Referring to the drawing, there is shown in FIG. 1 a photoconductive camera tube 10 of a type commercially known as a vidicon. The tube 10 comprises an evacuated, generally cylindrical, glass envelope 12 closed at one end by a transparent faceplate 14 and at the other end by a glass stem 16 through which lead-in pins 18 are vacuum sealed. The envelope 12 is preferably a precision bulb that has an inner diameter held to a tolerance of plus or minus 0.001 inch (0.0254 mm) and that has fairly close tolerances with respect to roundness and thickness.

The tube 10 includes a conventional electron gun 20 that is positioned within one end of the envelope 12 substantially on the axis of the tube 10. The electron gun 20 comprises a thermionic cathode 22 for producing an electron beam that is directed toward a target electrode 24 by a control grid 26, an apertured accelerating electrode 28 and a hollow tubular beam focusing electrode, or G3 electrode 30, that accelerate and focus the electron beam.

The target electrode 24 preferably comprises a layer of lead monoxide deposited on a film of transparent conductive material such as tin oxide. Other photoconductive materials, such as selenium arsenic telluride, cadmium selenide, or antimony trisulfide may also be used to form the target electrode 24. An electrical contact may be made to the target 24 by a metallic lead 32, vacuum sealed through the envelope 12.

The tubular beam focusing electrode 30 is terminated at the end proximate the target electrode 24 by a fine mesh screen or beam decelerating electrode 34 that is supported by an annular ring 36 affixed substantially concentrically to focusing electrode 30. The mesh screen 34 is preferably of the electroformed type having 500 to 1000 wires per inch (197 to 394 wires per cm).

The beam focusing electrode 30 has an enlarged, elongated cylindrical portion 38, which is supported substantially concentrically within the inner surface 40 of the envelope 12 by a pair of novel support rings 42. It should be noted that depending upon the length of the electrode 30 and other physical constraints, one or more support rings 42 may be utilized.

Figure 2:
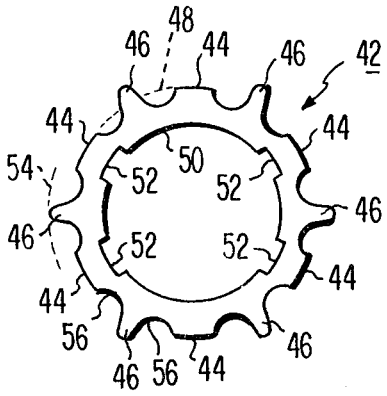
FIG. 2 is a plan view of a centering and supporting ring that is used in the present electrode support arrangement, shown prior to assembly with the tube.

Referring to FIG. 2, the support ring 42 is shown prior to assembly into the tube 10. The support ring 42 comprises a plurality of radial centering sectors 44 and, in the preferred embodiment, a plurality of radial finger-like fitting members 46. The ring 42 is preferably formed of a resilient material having a thickness of 0.003 to 0.010 inch (0.0762 to 0.2540 mm) and having relatively high strength and low thermal conductivity, with a coefficient of thermal expansion similar to that of the beam focusing electrode 30. Preferred materials are nickel-chromium alloys, such as Nichrome (trade name) and Inconel (trade name), that are available from Wilbur B. Driver Co., Harrison, New Jersey and International Nickel Co., New York, N.Y., respectively.

Each of the centering sectors 44 is formed to have an arcuate portion which together define a centering circumference 48. The diameter of the centering circumference 48 is held within a tolerance of plus or minus 0.0005 inch (0.0127 mm) and within 0.0005 to 0.004 inch (0.0127 to 0.1016 mm) of the diameter of the precisely formed inner surface 40 of the glass envelope 12, so that the spacing between the centering circumference 48 and the inner surface 40 does not exceed 0.002 inch (0.0508 mm).

In the structure shown in FIG. 2, the support ring 42 is formed to have an inner surface 50 having a diameter less than the diameter of the enlarged portions 38 of the electrode 30 to provide a tight interference fit between the support spring 42 and the beam focusing electrode 30. A number of cut-outs 52, wherein some of the inner surface 50 is removed to reduce the surface bearing upon the electrode portion 38, are formed to provide a snug fit between the ring and the electrode without binding during assembly. The inner surface 50 is formed to be concentric to the centering ring circumference 48 within 0.001 inch (0.0254 mm).

The periphery of the finger-like members 46 are formed to extend radially beyond the centering ring circumference 48 where together they define a fitting ring circumference 54. The diameter of the fitting ring circumference 54 is formed to be greater than the diameter of the inner surface 40 of the envelope 12. The members 46 are formed to bend during assembly against the envelope inner surface 40 in a direction transverse the plane of the ring 42. To facilitate this bending, it is preferable to provide a cut-out 56 on either side of each member 46 so that the wall thickness of the ring 42 on either side of each member 46 is less than the wall thickness at the radial sectors 44.

The beam focusing electrode 30 and the support ring 42 are assembled to each other and into the envelope 12 as follows. A sub-assembly comprising the electrode 30 and two support rings 42 is formed in a fixture for force-fitting the ring inner surface 50 onto the outer surface of the electrode enlarged portion 38. The rings 42 are disposed near each end of the enlarged portion 38. Because of the concentricity tolerance of the inner surface 50 of the supporting ring 42 to the centering circumference 48, the interference fit provides a similar concentricity tolerance between the centering circumference 48 and the outer surface of the envelope portion 38. In addition, the force fit strengthens the electrode against elipticity.

Figure 3:
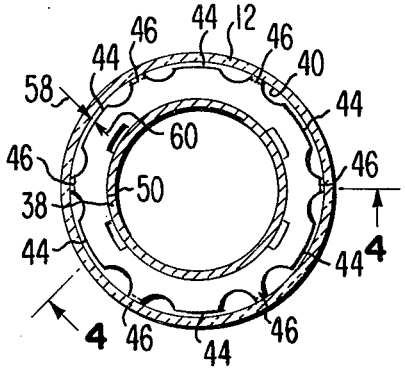
FIG. 3 is a sectional view taken along the viewing line 3—3 of FIG. 1.
Figure 4:
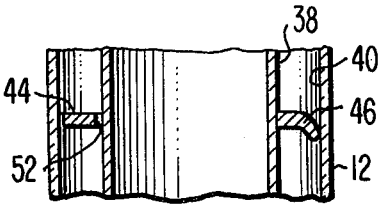
FIG. 4 is an enlarged fragmentary sectional view taken along viewing lines 4—4 of FIG. 2.

After the mesh screen 34 and annular ring 36 are affixed to the electrode 30 and the target electrode 24 is suitably deposited, the electrode sub-assembly is inserted into the envelope 12. Upon insertion, the finger-like members 46 are flexed rearwardly away from the target electrode 24 and resiliently engage the inner surface 40 of the envelope 12 in a frictional contact, guiding the rings 42 into the envelope without deforming the radial sectors 44. The structure of the support rings 42 after insertion, is shown in more detail in FIGS. 3 and 4.

It should be noted in this present electrode supporting structure that the resilient finger-like members 46 are not utilized to either initially obtain concentricity of the electrode 30 within the envelope 12 or to maintain the concentricity after experiencing adverse environmental conditions. The finger-like members 46 are utilized to fit the ring 42 into the envelope 12 and to provide the direct contact between the ring 42 and the envelope 12. The concentricity is established by the close spacing, i.e., within 0.002 inch (0.0508 mm), between the radial centering sectors 44 and the inner surface 40 of the envelope as shown by the arrows 58 and 60 in FIG. 3. No other fixturing is necessary to obtain the desired concentricity upon assembly. In addition, if under normal operating conditions the finger-like members have a tendency to shift position somewhat, the radial sectors 44 will act as a mechanical stop preventing any loss in concentricity beyond the maximum initial spacing between the envelope inner surface 40 and the centering circumference 48.

Several camera tubes have been constructed utilizing the improved supporting and centering structure and have been compared with tubes made with conventional supporting rings having radial spring elements. In all of these tubes, the inner diameter of the glass envelope 12 was formed to a dimension of 1.074 to 1.076 inches (2.728 to 2.733 cm). In the novel supporting structure, the centering circumference 48 of the radial sectors 44 was formed to a diameter of 1.0725 to 1.0735 inches (2.724 to 2.727 cm). Special equipment was used to accurately measure the spacing between the beam focusing electrode enlarged portion 38 and the inner surface 40 of the envelope 12. In a group of eight standard tubes, the measured spacing varied between 0.001 to 0.005 inch (0.0254 to 0.1270 mm) while in a group of six tubes with the novel supports, the measured spacing varied between 0.0003 to 0.002 inch (0.00762 to 0.0508 mm). Since both groups were measured after normal processing, it can be seen that the novel supporting structure provides a significant improvement in structural integrity in maintaining concentricity between the electrode and envelope.

Figure 5:
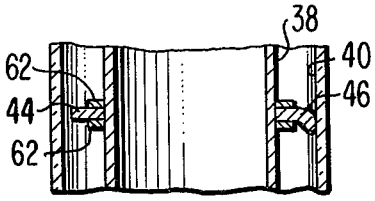
FIG. 5 is the view of FIG. 4, showing an alternative embodiment of the improved electrode support structure.

Having described the preferred embodiment of the electrode supporting structure, there is shown in FIG. 5 an alternative arrangement for attaching the support ring 42 to the electrode 30 instead of using the interference fit. In this arrangement, the diameter of the inner surface 50 of the ring 42 is formed to be slightly greater than the diameter of the enlarged portion 38 of the electrode 30. The support ring is then attached as by spot-welding a ring band 62 on one or both sides of the ring 42 and to the electrode 30. The ring band 62 is formed to have an inner diameter greater than, but close to the outer diameter of the electrode 30, and an outer diameter less than the diameter of the centering circumference 48. The cut-outs 52 in support ring 42 may be eliminated and the tolerance of the diameter of inner surface 50 and the concentricity tolerance may be loosened. The concentricity of the centering circumference 48 to the outer surface of the electrode portion 38 may be achieved in a sub-assembly fixture in which the ring bands are welded. In addition, the ring bands 62 also provide more rigidity to the radial sectors 44.

Even though the preferred embodiment of the support structure as hereindescribed comprises an integral support ring 42 including centering radial sectors 44 and finger-like fitting members 46, it should be noted that separate centering rings and fitting rings cooperating to provide the novel support structure may also be used.

Although the present support structure has been described in the preferred embodiment of a photoconductive camera tube, it should also be appreciated that the novel support structure is not so limited. The support structure may also be utilized in other electron tubes to center and support, for example, cylindrical electron gun electrodes in a cathode ray tube envelope such as a color kinescope tube or focusing or accelerating cylindrical electrodes in a phototube bulb.

What is claimed is:

1. In an electron tube of the type including an evacuated envelope having a cylindrical inner surface, a faceplate closing one end of said envelope, an electron gun disposed at an end of said envelope opposite said faceplate, a tubular electrode contained within said envelope and spaced from the cylindrical inner surface thereof, said electrode having an enlarged, elongated cylindrical portion disposed between said electron gun and said faceplate for passing an electron beam therethrough, and means for supporting said electrode in said envelope, the improvement wherein said supporting means comprises:

a centering ring having a plurality of centering sectors defining a centering circumference, the diameter of said circumference being less than, but formed closely to, the diameter of the cylindrical inner surface of said envelope;

means for attaching the centering ring to an outer surface of said electrode in at least two places between the ends of and surrounding said electrode so that the centering circumference is substantially concentric with the outer surface of said electrode; and means for resiliently fitting said electrode with said attached centering ring to the inner surface of said envelope so that the concentricity of the outer surface of said electrode to the inner surface of said envelope is determined by the spacing between said centering circumference and the inner surface of said envelope, said fitting means being formed to flexibly contact the inner surface of said envelope.

2. An electron tube according to claim 1, wherein said radial centering sectors are spaced substantially equally around said centering ring, the outer surface of each sector being formed arcuately to conform to the centering circumference of said ring.

3. An electron tube according to claim 2, wherein said fitting means comprises integrally with said ring, a plurality of radial members spaced substantially equally around said ring and intermittent said sectors, the periphery of said members defining a fitting circumference having a diameter that is greater than the diameter of the inner surface of said envelope portion, so that when said electrode with the attached centering ring is inserted into said envelope, said radial members are flexed to bear against the inner surface of said envelope and guide the ring into the envelope without deforming said sectors.

4. An electron tube according to claim 3 wherein said centering ring having said radial sectors and members is a nickel-chromium alloy having a thickness in the range of 0.003 to 0.010 inch (0.0762 to 0.2540 mm).

5. An electron tube according to claim 3, further including means to facilitate the flexing of said radial members against the inner surface of said envelope.

6. An electron tube according to claim 5, wherein said facilitating means comprises a cut-out of said centering ring on either side of each of said radial members, the wall thickness of said centering ring on either side of of said members being less than the wall thickness at said radial sectors, so that upon being stressed said radial members will readily flex.

7. An electron tube according to claim 1, wherein the spacing between the centering circumference of said centering ring and the inner surface of said envelope is not greater than 0.002 inch (0.0508 mm).

8. An electron tube according to claim 1, wherein said attaching means comprises a ring band having an inner diameter greater than, but relatively close to, the outer diameter of said electrode, and having an outer diameter less than the diameter of the centering circumference of said centering ring, wherein the ring band is mechanically fastened to said centering ring and to said electrode to thereby secure said centering ring in a fixed position relative to said electrode.

9. An electron tube according to claim 1, wherein said attaching means comprises an interference fit between the centering ring and said electrode, wherein the inner diameter of said centering ring is less than the outer diameter of said electrode, so that upon engagement of the centering ring inner surface with the electrode outer surface a tight force fit is provided therebetween.

10. An electron tube according to claim 1, further comprising a photoconductive target layer disposed on an inner surface of said faceplate and wherein said two places between the ends of and surrounding said outer surface of said electrode for attaching said centering ring include one place proximate said electron gun and one place proximate said target layer.

* * * * *